US006167909B1

(12) United States Patent
Davis

(10) Patent No.: US 6,167,909 B1
(45) Date of Patent: Jan. 2, 2001

(54) CORROSION AND CONTAMINANT RESISTANT SLIDE VALVE

(75) Inventor: Michael Davis, Liverpool, NY (US)

(73) Assignee: Tactair Fluid Controls, Inc., Liverpool, NY (US)

( * ) Notice: Under 35 U.S.C. 154(b), the term of this patent shall be extended for 0 days.

(21) Appl. No.: 09/407,731

(22) Filed: Sep. 28, 1999

(51) Int. Cl.[7] ..... F15B 13/043

(52) U.S. Cl. ..... 137/624.27; 137/625.64; 137/625.66

(58) Field of Search ..... 137/624.27, 625.64, 137/625.66

(56) References Cited

U.S. PATENT DOCUMENTS 3,640,146 * 2/1972 Barnes ..... 137/624.27 X
4,041,983 * 8/1977 Bianchetta ..... 137/624.27 X
4,046,165 * 9/1977 Rose et al. ..... 137/624.27
4,848,404 * 7/1989 Hickok ..... 137/625.66 X

FOREIGN PATENT DOCUMENTS 2201227 2/1987 (GB) .

* cited by examiner

*Primary Examiner*—Gerald A. Michalsky
(74) *Attorney, Agent, or Firm*—Wall Marjama & Bilinski

(57) ABSTRACT

A slide valve containing a ceramic apertured slide block slidably supported upon a pair of ceramic shear seals so that the slide can reciprocate between an operative and an inoperative position. A roof block also formed of a ceramic material is mounted over the slide block and a roller unit is positioned between opposing surfaces of the two blocks. Control pistons are mounted in cylinders on either side of the slide block. Control circuits are arranged to bring pilot fluid in a selected one of the cylinders to extend the piston housed therein against the slide thus changing the slide position. The control circuits are isolated from other circuits within the valve to prevent contaminants from adversely effecting poppet valves operatively associated with the control circuits.

10 Claims, 3 Drawing Sheets

CORROSION AND CONTAMINANT RESISTANT SLIDE VALVE

BACKGROUND OF THE INVENTION

This invention relates to a slide valve in which an apertured slide block is reciprocally moved between an operative position wherein a supply line carrying supply fluid under pressure is coupled to a function line to provide power to hydraulic equipment and, in particular, to a slide valve having improved corrosion resistance and protection from the adverse effects of contaminants that might be carried into the valve from the valve return line.

Slide type valves are oftentimes mounted in inaccessible locations and thus must maintain their functional capabilities over long periods of time without the benefit of scheduled maintenance. One widely used form of this type valve contains an apertured slide that can be positioned to control the flow of a fluid from a pressurized supply line to a function line that services some type of hydraulic equipment when the slide is placed in an operative position and coupling the function line to an unpressurized return line when the slide is placed in an inoperative position.

Movement of the slide plate is typically achieved by two pistons that are arranged to act upon opposite sides of the slide block. The pistons are mounted in cylinders and are under the control of poppet or pilot valves that are activated by solenoids. To change the slide blocks position, a selected solenoid is energized for a short period of time causing a pulse of pressurized pilot fluid to be introduced into one of the piston cylinders which, in turn, causes the piston to move the slide to the desired position. Once the change of position is achieved, the solenoid is deenergized and the pressurized cylinder is coupled through the poppet valve to a return line to vent the cylinder.

The typical prior art slide valve is also equipped with a failsafe device that is usually mounted behind the valve closing piston. The failsafe device generally includes a spring actuated failsafe piston, that uses supply pressure to hold a return spring in a loaded condition as long as the pressure in the supply line is maintained above a given level. In the event of a pressure loss in the supply line, the holding force acting upon the piston is reduced to a point wherein the spring is permitted to unload. This, in turn, drives the failsafe piston into moving contact with the valve closing piston thus moving the slide to an inoperative position.

The space between the failsafe piston and the valve piston is in communication with the poppet valve control circuit. When there is low pressure in the supply line and the failsafe piston has moved against the valve closing piston, the space between the pistons becomes vented to the return line through the poppet valve. When pressure is again applied to the supply line, the failsafe piston is moved back creating a void in the space between the two pistons which causes fluid from the return line to be drawn into the void through the associated poppet valve circuit. If contamination is present in the return fluid, and it usually is, it can collect in the working parts of the poppet valve preventing it from fully closing under certain conditions. With the poppet valve partially open, pilot fluid under pressure will have an open path to the system return line and the supply of pilot fluid will be rapidly depleted. This rapid depletion of fluid is extremely costly and can produce serious operating problems with regard to the equipment being serviced by the slide valve.

SUMMARY OF THE INVENTION

It is a primary object of the present invention to improve slide valves and, in particular, slide valves used in remote and generously inaccessible locations.

It is a further object of the present invention to enhance the ability of a slide block used in a slide valve to efficiently change position to open or close the valve.

A still further object of the present invention is to prevent the unwanted loss of pilot fluid from a slide valve.

Another object of the present invention is to provide an improved slide valve that can operate over long periods of time without the need of scheduled maintenance.

These and other objects of the present invention are attained by a slide valve mechanism that includes a housing containing a slide chamber and an apertured slide block reciprocally mounted in the chamber for movement between an operative position wherein a supply line for carrying fluid under pressure is coupled to a function line servicing hydraulic equipment and an inoperative position wherein the function line is coupled to a return line. A pair of control pistons are mounted in cylinders on opposite sides of the slide block and the pistons are selectively moved into contact with the slide block to change the valve between an operative and an inoperative state. The valve closing piston has an elongated nose section that passes through a failsafe chamber. A failsafe piston is slidably mounted upon the nose section within the failsafe chamber and a compression spring is wound about the nose section to act between the rear wall of the chamber and the failsafe piston. An elongated groove is formed about the outside of the failsafe piston to create a sealed cavity with the inside wall of the failsafe chamber. The cavity is connected to the supply line and adapted so that the failsafe piston is moved back under normal supply pressure to place the spring in a loaded condition. In the event supply pressure is lost, the spring unloads to force the failsafe piston into driving contact with the slide block, thus moving the slide block rapidly into an inoperable position. Unlike prior art slide valves, the present failsafe piston chamber is isolated from the poppet valve control circuit and thus return fluid is not drawn into the poppet valve any time the failsafe piston is cycled.

In one embodiment of the invention, the slide block is supported upon a pair of shear seals and a roller assembly is positioned between the top surface of the slide block and a roof block. The slide block, shear seals and roof block are constructed of a ceramic material with the opposing surfaces of the two blocks being held in close flat and parallel alignment.

BRIEF DESCRIPTION OF THE DRAWINGS

For a better understanding of these and other objects of the present invention, reference will be had to the following detailed description of the invention which is to be read in association with the accompanying drawings, wherein.

DESCRIPTION OF THE INVENTION

Figure 1:
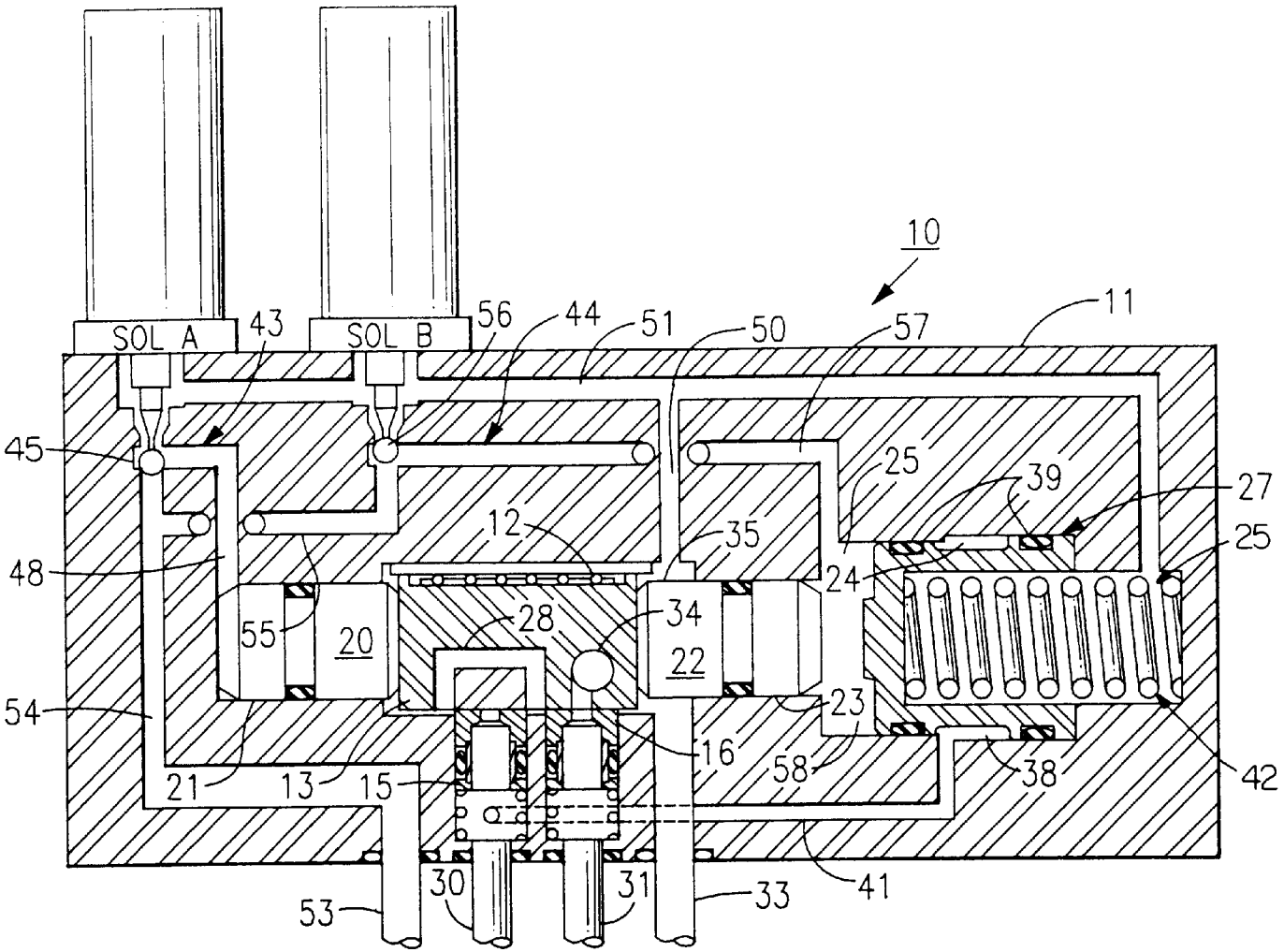
FIG.1 PRIOR ART
FIG. 1 is a side elevation in section of a prior art slide valve utilizing a pair of shear seals to support an apertured slide block.

Turning initially to FIG. 1, there is shown a slide valve assembly, generally referenced 10, that is well known in the prior art. The valve assembly includes a housing 11 formed of metal and having a slide chamber 12 therein, in which a slide block 13 is mounted for reciprocation between a first operative position and a second inoperative position. The slide block as shown is in the inoperative position. The slide is supported in the slide chamber upon a pair of shear seal units 15 and 16. Shear seal units are well known in the art and its construction will not be described in detail herein except to say that each unit has a channel passing therethrough that can couple a line such as supply line 30 or function line 31 to an aperture in the slide block.

The position of the slide block is changed by a pair of pistons arranged on opposite sides of the block. A valve opening piston 20 is located on one side of the slide block in a valve opening cylinder 21 and a valve closing piston 22 is located on the other side of the slide block in a valve closing cylinder 23. The back of the valve closing cylinder opens into a larger cavity 25 which slidably contains a failsafe piston 27.

The slide block contains a U-shaped aperture 28 formed therein that is capable of being aligned with the channels in the adjacent shear seals when the slide block is moved to the operative position. When the valve is in the operative position, shear seal 15 is coupled to a supply line 30 which is arranged to bring supply fluid under pressure to the valve. Shear seal 16 is coupled to a function line 31 which is arranged to provide supply fluid to actuators or the like (not shown) which carries out a desired work function. When the slide is placed in an inoperative position, as shown in FIG. 1, the function line 31 is coupled internally to a return line 33 via opening 34 in the slide block 13. The cylinder 23 and the slide chamber 12 are in communication and coact to form a common internal area 35 that is held at return line pressure which is typically ambient pressure.

A failsafe piston 27, as noted above, is mounted within its chamber 25. The piston contains an elongated groove 24 formed about its outer surface which establishes a cavity 38 with the inner wall of the failsafe chamber 27. The cavity is sealed at both ends by 0-rings 39 and is connected directly to the supply line port 30 via internal channel 41. Accordingly, the failsafe cavity is exposed to supply line pressure. A failsafe spring 42 is contained within a blind hole formed into the back of the failsafe piston and the back section 25 of the failsafe chamber. When cavity 38 is exposed to normal supply line pressures, the failsafe piston is moved back to place the spring in a loaded condition.

Cycling of the control pistons 20 and 22 is achieved through means of a pair of fluid control circuits 43 and 44, respectively. A first poppet valve 45 is mounted in valve opening control circuit 43 which supplies fluid to the back face of the valve opening piston via internal channel 48. One side of the poppet valve 45 is coupled to the common return area 35 by lines 50 and 51 while the other side of the valve is connected to a pilot line 53 via internal channel 54. The second poppet valve 56 is similarly connected to the common return area and to pilot line 53 via channels 54 and 55 and is likewise adapted to apply fluid via channel 57 to the space 58 behind the valve closing piston 22.

Poppet valve 45 is under control of solenoid A and poppet valve 56 is under control of solenoid B. When the solenoids are deenergized, the associated poppet valves are arranged to connect the back of each control piston cylinder to the return line 33. Upon energization of a selected one of the solenoids, the area behind the associated piston is connected through the poppet valve to the pilot line and pilot fluid under sufficient pressure to move the associated piston forward is delivered to the back of the piston. The solenoid is held energized for a short period of time sufficient to permit the slide to move from one operative position to another and the solenoid is then deenergized whereupon the region behind each piston is connected through the associated poppet valve to return line pressure. The slide is held in the selected position by friction primarily exerted upon the slide member by the shear seals 15 and 16.

As noted above, the area 58, behind the valve closing piston 22 is connected to poppet valve 56 in control circuit 44 by channel 57. This circuit, in turn, is vented to return line 33 when the associated solenoid B is deenergized. At start up or at any time pressure is lost in the supply line, the failsafe piston will be moved into contact with the back of the valve closing piston. Once normal pressure is regained at the supply line, the failsafe piston will be moved back away from the valve closing piston as shown in FIG. 1. As the failsafe piston is being moved back, fluid from the return line is drawn into the area 58 between the failsafe piston and valve closing piston 22. If contaminants are present in the return line, they can also move into the poppet valve through line 44, thus preventing the valve from properly closing. This, in turn, allows pilot fluid to continually leak through the open valve into the return line when the solenoid B is deenergized. The supply of this expensive fluid can be rapidly depleted. This is not only a waste of expensive fluid, but can adversely effect the equipment being serviced by the slide valve in the event the pilot fluid becomes completely depleted while operations are being conducted.

As will be explained in detail below the slide valve of the present invention is configured so the area housing the slide block and the failsafe piston is isolated from the valve closing piston cylinder. The failsafe chamber is further connected directly to a common return region rather than passing through the poppet valve control circuit. Accordingly, contaminants from the return line are prevented from reaching the pilot valves when the failsafe device associated with the valve is cycled.

Figure 2:
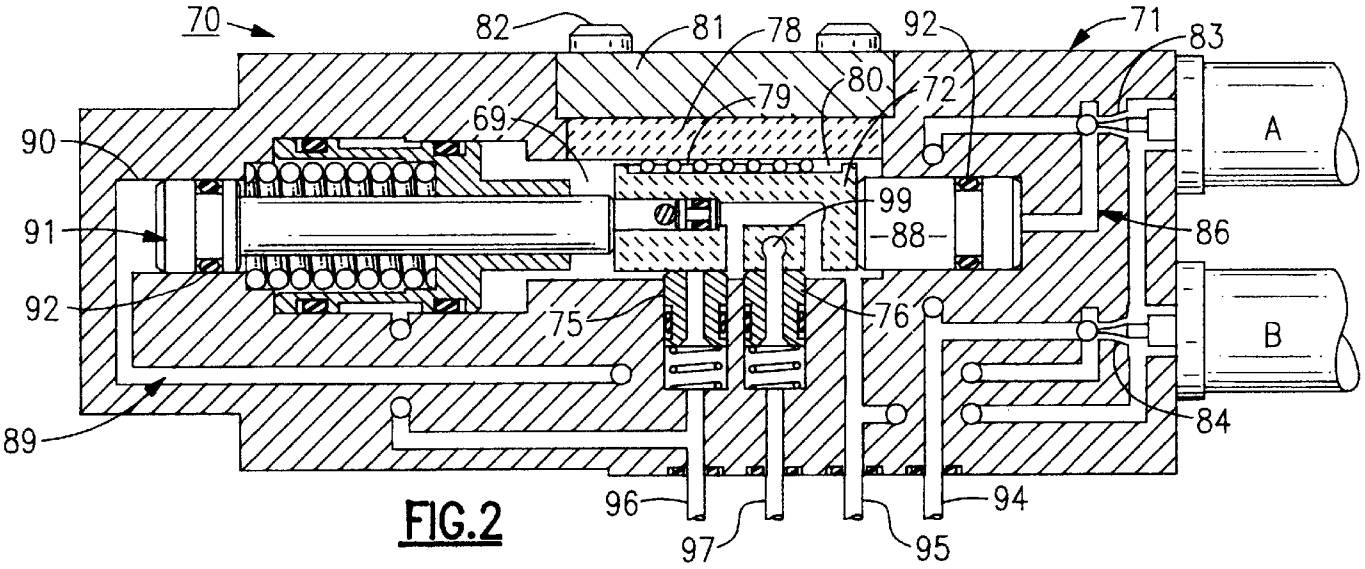
FIG. 2 is a side elevation of a slide valve embodying the teachings of the present invention showing the slide block in an inoperative position.
Figure 3:
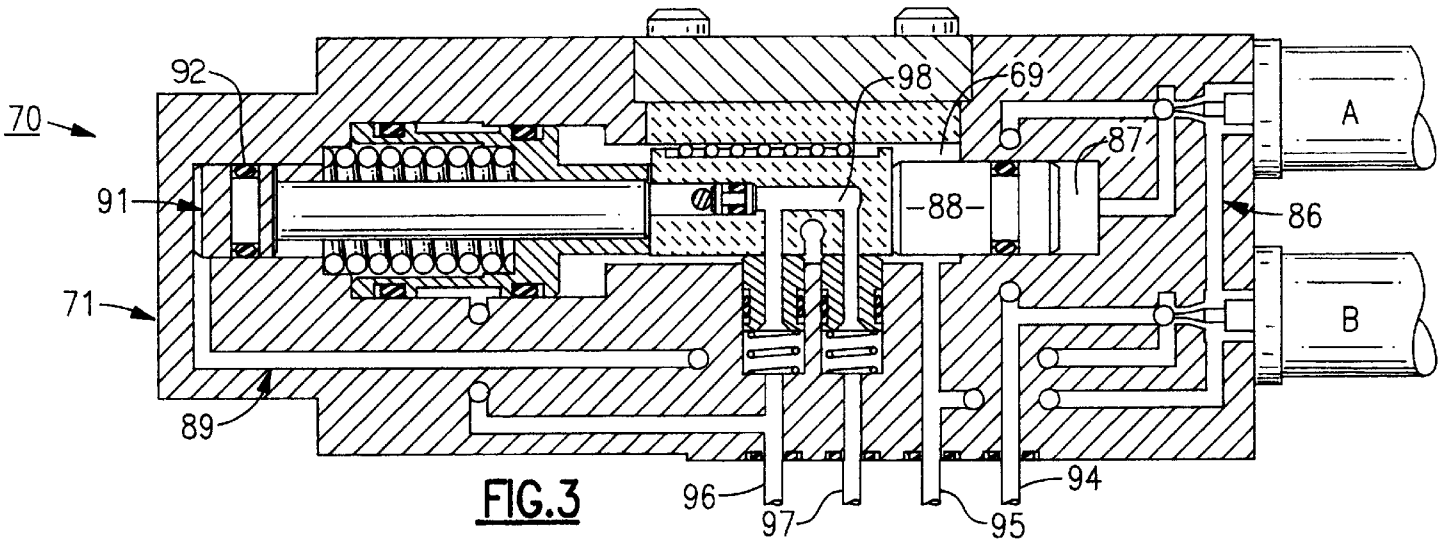
FIG. 3 is a side elevation of the slide valve illustrated in FIG. 2 showing the slide block in an operative position.
Figure 4:
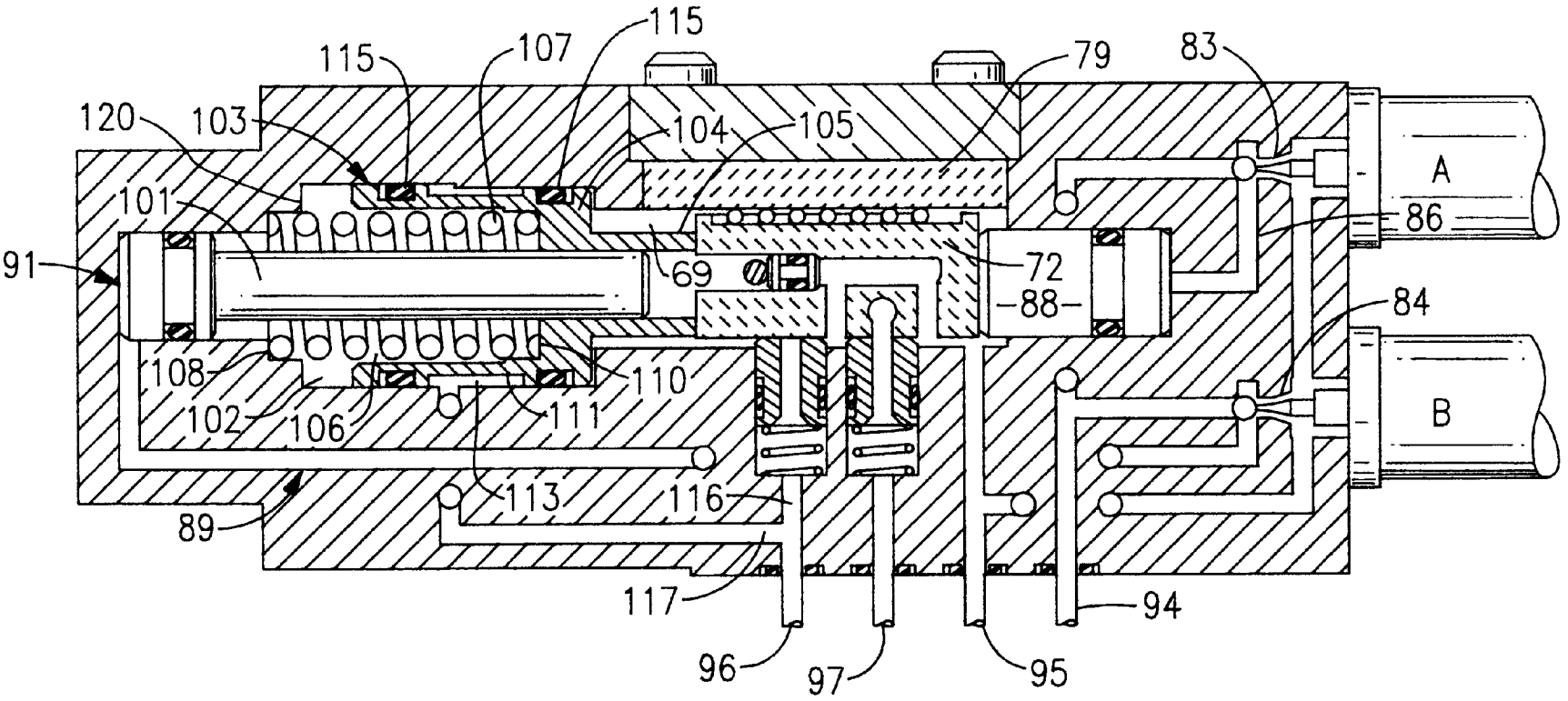
FIG. 4 is also a side elevation of the present slide valve showing the failsafe mechanism being extended to place the slide valve in an inoperative position.

Turning now to FIGS. 2 through 4 there is shown a slide valve generally referenced 70 embodying the teachings of the present invention. The valve includes a housing 71 having a central common chamber 69 in which an apertured slide block 72 is slidably maintained so that it can reciprocate between an operative position as illustrated in FIG. 3 and an inoperative position as illustrated in FIG. 2. Here again, the slide block is slidably supported upon shear seals 75 and 76. A roof block 78 is mounted directly over the slide block and a needle bearing assembly 79 is mounted in a recess 80 located in the top surface of the slide block which provides a rolling contact between the roof block and the slide block. A cover 81 is mounted in the housing over the roof block and is held in place by screws 82.

It is important, in order to ensure proper and reliable operation of the slide block that the opposing top and bottom surfaces of the blocks be flat and parallel as well as being corrosion resistance. Heretofore, both the slide and the roof of the slide chamber were constructed of metal. Many metals are susceptible to corrosion over a period of time. This in turn, can adversely effect the movement of the slide due to increased frictional forces as well as sealing ability. To provide the present valve with enhanced performance and reliability, the shear seals, slide block and the roof block are all fabricated of a hard ceramic material that is both wear resistant and corrosion resistant. In addition, the opposing block surfaces can be polished and lapped to provide for greater flatness and smoothness.

As in the prior art valve described above, the present valve contains a pair of poppet valves 83 and 84 that are controlled by solenoids A and B, respectively. Poppet valve 83 is connected via a flow circuit 86 to the back of a valve opening cylinder 87 containing a valve opening piston 88. Similarly, poppet valve 84 is connected via a flow circuit 89 to the back of a valve closing cylinder 90 containing valve closing piston 91. Both pistons contain O-ring seals 92 that prevent fluid from passing between the cylinder walls and the pistons contained therein.

As explained above, energizing one of the solenoids will bring pilot fluid under pressure from the pilot fluid line 94 into the associated cylinder causing the piston to extend, thus moving the slide block to change the operational state of the valve. Once the selected piston is fully extended, the solenoid is deenergized, thus connecting both cylinders to the return line 95 whereupon the slide block is held in the selected position by friction that is primarily provided by the two shear seal units.

The common chamber 69 of the housing in which the slide block is mounted is connected to the return line 95 and thus is always maintained at the relatively low line pressure.

When the slide block is moved to the operative position, as shown in FIG. 3, the supply line 96 is connected to the function line 97 through the aperture 98 in the slide block to bring supply fluid to the equipment being serviced by the valve. Moving the slide block to the inoperative position, as shown in FIG. 2, disconnects the supply line from the function line and couples the function line to the return line through opening 99.

As best illustrated in FIG. 4, the valve closing piston 91 contains an elongated nose section 101 that passes out of the cylinder through an expanded failsafe chamber 102 and into the common chamber 69. A failsafe piston 103 is slidably contained upon the nose section of the valve closing piston within the failsafe chamber. The failsafe piston includes a body section 104 and a nose section 105 that protrudes forward of the main body section toward the slide block. The back of the body section contains a blind hole 106 in which a failsafe return spring 107 is housed. The spring is preferably a coil spring that is wound about the nose section 101 of the valve closing piston and which is arranged to act between a rear shoulder 108 formed in the back of failsafe chamber and the inner wall 110 of the blind hole formed in the body of the piston. A cylindrical groove 111 is formed about the outer surface of the failsafe piston body and forms a cavity 113 with the cylindrical inside wall of the failsafe chamber. A pair of opposed seals 115 surround the body of the failsafe piston on either side of the groove and serve to render the groove fluid tight.

The groove in the failsafe piston is connected directly to the supply line port 116 by an internal channel 117 so that the groove is exposed to the supply line pressure. Under normal operating conditions when a desired operating pressure is being maintained in the supply line, the supply pressure in the groove of the failsafe piston will be sufficiently high enough to move the failsafe piston back against shoulder 120 of the failsafe chamber thus placing the spring in a loaded condition. The spring will be held in the condition as long as normal supply pressure is maintained in the supply port regardless of the position of the slide block or the conditions of either solenoid.

As illustrated in FIG. 4 in the event supply pressure is lost for some reason while the slide block is in an operative position, the holding pressure exerted on the failsafe piston is reduced to a point that permits the spring to unload. As the spring unloads, the failsafe piston is driven toward the slide block causing the nose of the failsafe piston to contact the side of the slide block and move the block rapidly into the inoperative position. The spring serves to hold the block in the inoperative position until such time as supply pressure returns to normal.

As should be evident from the description above, the poppet valve control circuits are isolated from both the failsafe and the common chamber and are arranged to communicate with the back of the control piston cylinders. Accordingly, as the failsafe piston is being reset after it has returned the slide block to an inoperative position, return fluid is drawn directly into the failsafe chamber and the common chamber from the return line. Unlike the prior art valve described above, return line fluid is not drawn through the control circuits as the failsafe piston is being reset. As a result, contaminants that might be present in the return line cannot reach the poppet valve during the reset period considerably reducing the danger of one of the poppet valves from being held open when the associated solenoid is deenergized. This, coupled with the ceramic guideway for the slide block, provides the present slide valve with extremely high reliability and long life so that the valve can be used in remote locations without having to be maintained over long periods of time.

While this invention has been explained with reference to the structure disclosed herein, it is not confined to the details set forth and this invention is intended to cover any modifications and changes as may come within the scope of the following claims:

What is claimed is:

1. A slide valve that includes a housing containing a slide chamber and an apertured slide block reciprocally mounted within the chamber for movement between an operative position for connecting a supply line to a function line and an inoperative position for connecting the function line to a return line, a first valve opening piston mounted within a first cylinder adjacent one side of said slide block for moving said slide block from an inoperative position to an operative position, a second valve closing piston mounted within a second cylinder adjacent an opposite side of the slide block for moving said slide block from an operative position to an inoperative position, control means for selectively moving said first and second pistons into contact with said slide plate to move the slide plate into a selected position, said second piston further including an elongated nose section for contacting said slide block, a failsafe piston contained within a failsafe chamber, said failsafe piston being slidably mounted upon the elongated nose section of said second piston, a spring mounted within said failsafe chamber being arranged to act between a rear wall of the failsafe chamber and the failsafe piston, a sealed cavity extending around the outer surface of the failsafe piston, flow means for connecting said cavity to said supply line, the geometry of said cavity being such that the failsafe piston is moved to a position to hold the spring in a compressed state when the pressure in said supply line is at or above a given pressure and to release the compressed spring when the pressure in the supply line falls below said given pressure whereby the failsafe piston is moved against slide block as the spring unloads placing the slide block in the inoperative position.

2. The slide valve of claim 1 wherein said housing encases a roof block mounted over the slide block roller means are mounted between opposing surfaces of said blocks.

3. The slide valve of claim 2 wherein said roof block and said slide block are both fabricated of a ceramic material.

4. The slide valve of claim 3 wherein opposing surfaces of the roof block and the slide block are both flat and parallel.

5. The slide valve of claim 4 wherein a bottom surface of the slide block is slidably supported upon a pair of ceramic shear seals.

6. The slide valve of claim 1 wherein said failsafe spring is a compression spring that is wound around the elongated nose section of said second piston.

7. The slide valve of claim I wherein said control means includes a pair of solenoid actuated poppet valves that are arranged to selectively bring pilot fluid under pressure into the piston chambers behind the first and second pistons for a period of time sufficient to move the slide plate to a selected position when an associated solenoid is energized.

8. The slide valve of claim 7 wherein the piston cylinders and failsafe cylinder are arranged such that the fluid chambers on both sides of the failsafe piston are connected directly to the return line.

9. The slide valve of claim 7 wherein the slide block will remain in the last commanded position even when the solenoid actuated poppet valves are de-energized.

10. The slide valve of claim 7 wherein the slide block is held in either the operative or inoperative position by frictional forces present between the piston seals and the piston chambers and also between the shear seals and the slide block.

* * * * *